United States Patent [19]

Allweil

[11] 4,222,401

[45] Sep. 16, 1980

[54] PORTABLE SHELTER

[76] Inventor: Avraham Allweil, 48 Levi Eshkol St., Tel-Aviv, Israel

[21] Appl. No.: 16,214

[22] Filed: Feb. 28, 1979

[51] Int. Cl.[3] ..... A45F 1/00

[52] U.S. Cl. ..... 135/1 R

[58] Field of Search ..... 135/1 R, 1 A, 4 R, 3 R, 135/15 PE

[56] References Cited

U.S. PATENT DOCUMENTS

| | | | |
|---|---|---|---|
| 659,981 | 10/1900 | McCall | 135/1 R |
| 2,268,317 | 12/1941 | Till | 135/1 R |
| 2,420,898 | 5/1947 | Miner | 135/1 R |
| 2,792,844 | 5/1957 | Clark | 135/1R |
| 3,480,023 | 11/1969 | McConnell et al. | 135/1 R |
| 3,586,013 | 6/1971 | Gladden | 135/1 R |
| 3,990,463 | 11/1976 | Norman | 135/1 R |

FOREIGN PATENT DOCUMENTS

| | | | |
|---|---|---|---|
| 1477376 | 3/1967 | France | 135/1 R |

*Primary Examiner*—J. Karl Bell

*Attorney, Agent, or Firm*—Ladas & Parry

[57] ABSTRACT

A portable shelter for example, for military use, designed to be carried in a compact collapsed state by the user, for example, a soldier and which can be readily erected so as to provide the user with a maximum amount of protection for example, under combat conditions.

8 Claims, 12 Drawing Figures

Fig. 5
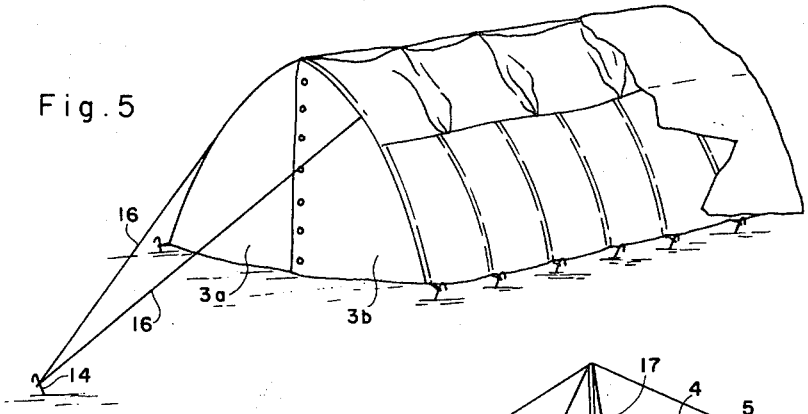
Fig. 6
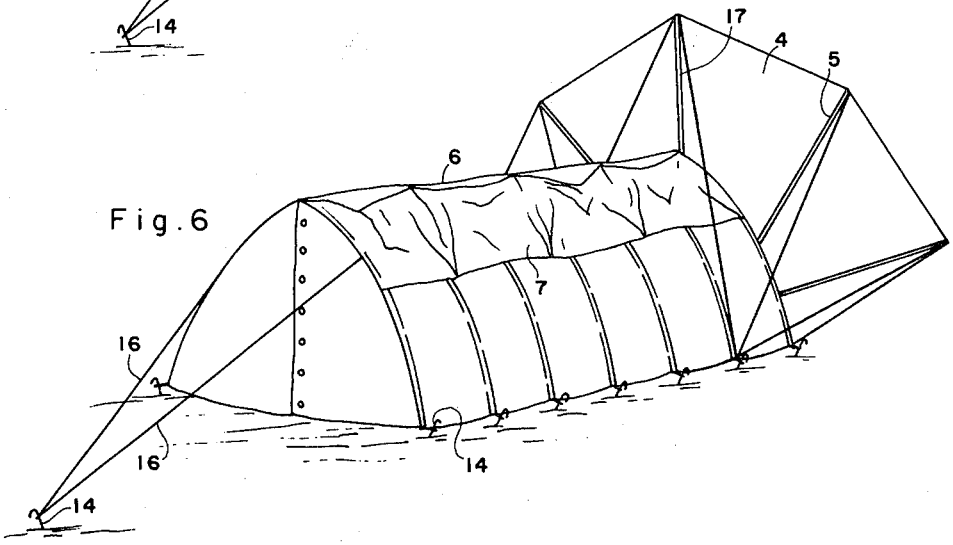
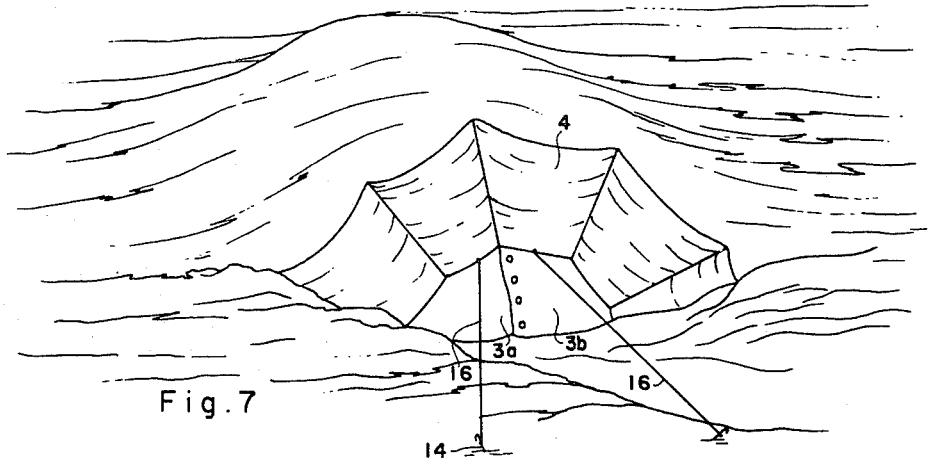
Fig. 7

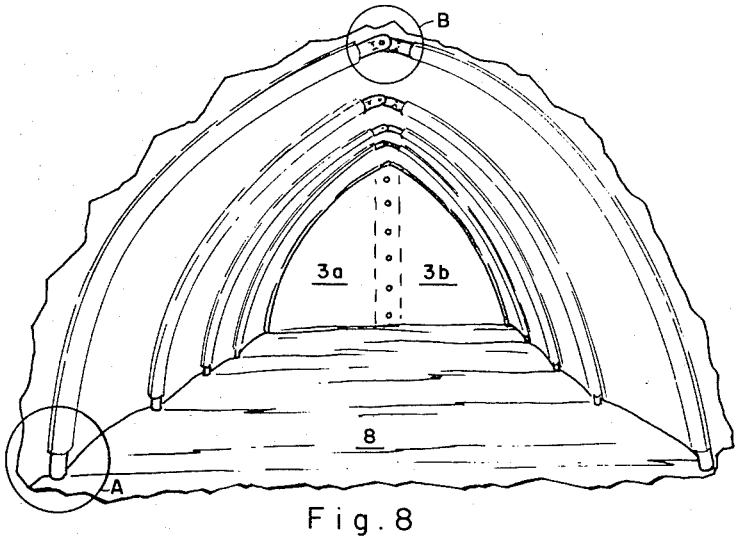
Fig. 8
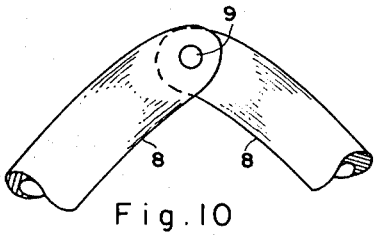
Fig. 10
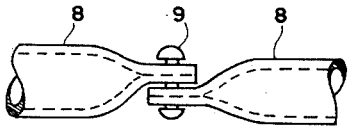
Fig. 11
Fig. 9
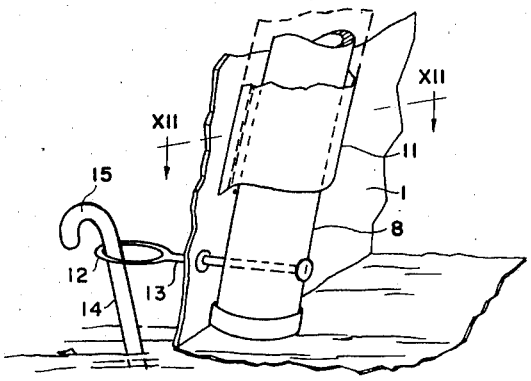
Fig. 12
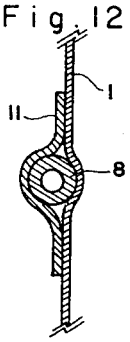

PORTABLE SHELTER

This invention relates to a portable shelter and is particularly concerned with a portable shelter for example, for military use, designed to be carried in a compact collapsed state by the user, for example, a soldier and which can be readily erected so as to provide the user with a maximum amount of protection for example, under combat conditions.

According to the present invention, these is provided a portable shelter comprising, (a) flexible fabric-like cover;

(b) a plurality of arch like rigid support members secured to axially spaced apart portions of the cover;

(c) an axially directed elongated retaining pocket formed on or secured to an outer surface of the cover adjacent to apical portions of the support members so as to open outwardly and upwardly when the shelter is erected;

said support members and their associated cover being extendable from a position wherein the support members are juxtaposed with respect to each other to a position where the support members are axially spaced apart, supporting therebetween the extended cover member so as to form an elongated enclosure.

Preferably, the shelter is provided with means, such as for example, fastening loops or the like, by means of which the erected shelter can be secured to the ground using appropriate staking pins.

When used, for example, by a soldier in combat conditions the compacted, collapsed shelter is carried by the soldier together with the rest of his kit. When combat conditions are such that the soldier requires shelter, the shelter can be rapidly erected on the ground or in a shallow trench excavated for this purpose, and the erected shelter is then covered with a layer of earth or sand. By virtue of the provision of the elongated axial open retaining pocket it is ensured that during the process of covering the erected shelter with the earth or sand, the initially deposited earth fills the pocket and presses vertically down on the arched support members in their arched condition and in consequence ensuring the maintenance of the shelter as a whole in its erected condition. But for the provision of these elongated axially directed retaining pockets, the deposited earth pressing against the sides of the shelter may result in the collapsing of the shelter.

Preferably, the shelter entrance is provided with a radially extending retaining wall, which in the collapsed condition of the shelter collapses around the compacted shelter. With such a retaining wall it is ensured that the deposited layer of earth or sand or the like does not spill over so as to block the entrance.

Figure 1:
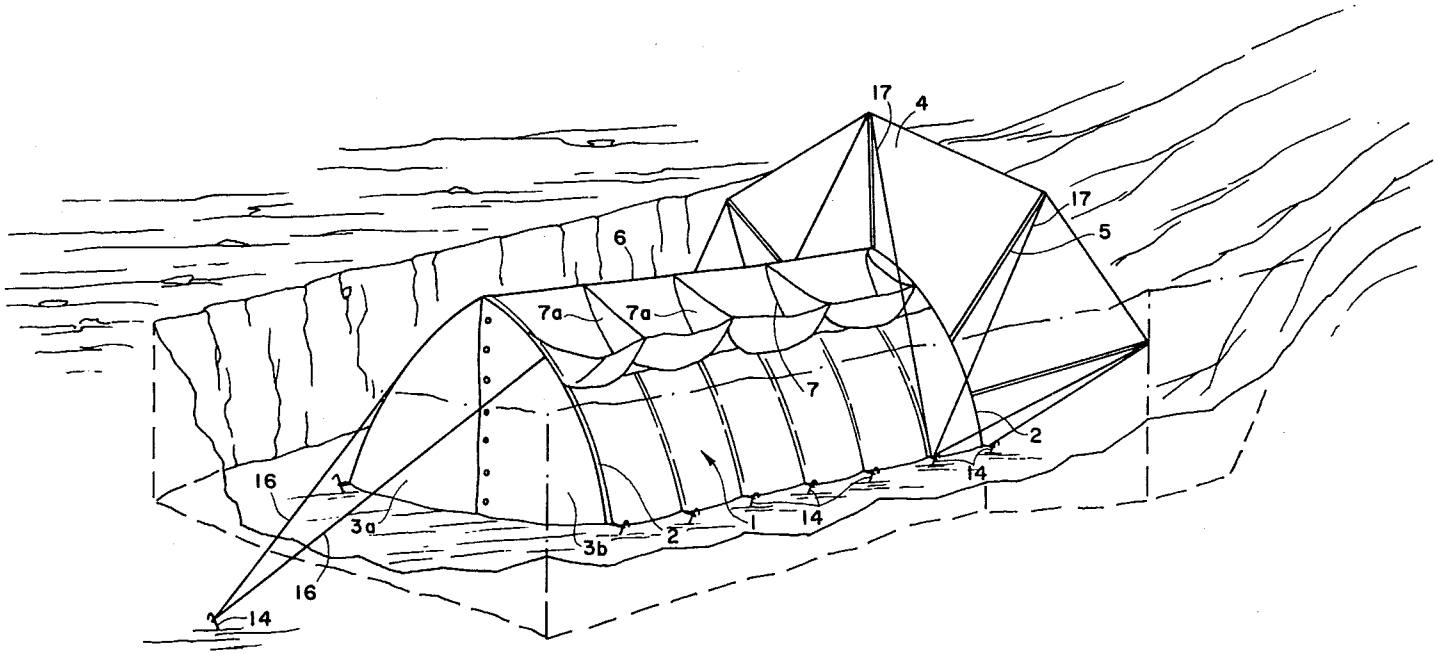
Figure 2:
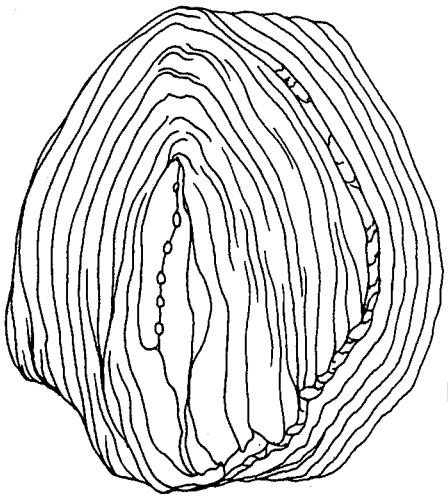

For a better understanding of the present invention, and to show how the same may be carried out in practice, reference will now be made to the accompanying drawings in which, FIG. 1 is a perspective view from the rear of an erected shelter in accordance with the present invention shown located in a shallow trench but not as yet covered with protective earth;

FIG. 2 is a perspective view of a stack of compacted collapsed shelters of the kind shown in FIG. 1, FIGS. 3, 4, 5 and 6 show, respectively, successive stages in the erection of the shelter, FIG. 7 shows the erected shelter when covered by a layer of protective earth, sand or the like, FIG. 8 is a perspective view showing the inside of the erected shelter, FIG. 9 a view on an enlarged scale of a detail A shown in FIG. 8, FIG. 10 is a view on an enlarged scale of a detail B shown in FIG. 8, FIG. 11 is a view from above of the detail shown in FIG. 10, and FIG. 12 is a cross sectional view of the detail shown in FIG. 9 taken along the line XII—XII.

As seen in the drawings, (particular attention is directed to FIG. 1 of the drawings) the shelter comprises a flexible fabric-like cover 1 supported on a plurality of axially spaced apart, arched, support members 2 so as to form in the extended erected state an arched enclosure having end closing flaps, 3*a*, 3*b* and, at an entrance end, an outwardly directed retaining wall 4 formed of the same fabric-like material as the cover and supported on substantially radially directed rectilinear support member 5, which are articulated with respect to an end arched support member 2.

Formed adjacent to and on either side of an apical portion 6 of the enclosure and extending axially therealong are two sets of retaining pockets 7, also formed of a fabric like material, which, in the erected state of the enclosure, open upwardly and which are provided with transversely directed reinforcing partitions 7*a*.

Preferably, and as seen in FIG. 8 of the drawings, the enclosure is formed with a base 8 which is integral with the cover 1, and is constituted of the same or similar fabric-like material.

As can be seen from FIGS. 9, 10 and 11 of the drawings, each arched support member 2 comprises a pair of curved tubular rods 8 formed suitably of aluminum and hinged together at their upper ends by hinge pins 9. The rods 8 are secured to the inner surface of the cover 1 by means of elongated fabric strips 11, which surround the supports 8 and are secured at the edges to the cover by bonding, stitching or the like. These strips 11 can, as shown be unitary or be consituted by separate spaced apart component strips (not shown).

As can be clearly seen, in FIG. 9 of the drawings a tie loop 12 is secured to the lower end of each rod 8 by means of a tie chord 13 which extends through an aperture formed in the cover and is secured to the support rod 8. Staking pins 14 having hooked ends 15 extend through the tie loops 12 and, when pushed into the ground, secure the erected extended structure with respect to the ground. The securing of the erected structure to the ground is completed by means of tie chords 16 which are respectively secured at either end of the structure to outermost support members 2 and which are secured by means of staking pins 14 in taut positions. The flexible retaining wall 4 is retained in position by means of tie chords 17, which are secured to the outermost ends of the radial support rods 5 and which are tethered to appropriate staking pins 14.

Figure 3:
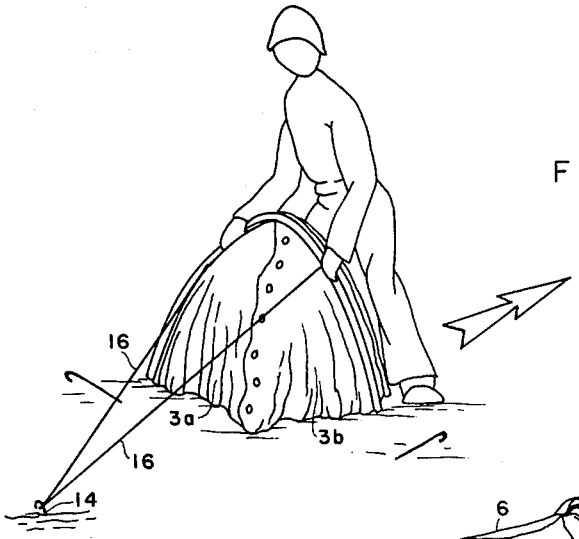
Figure 4:
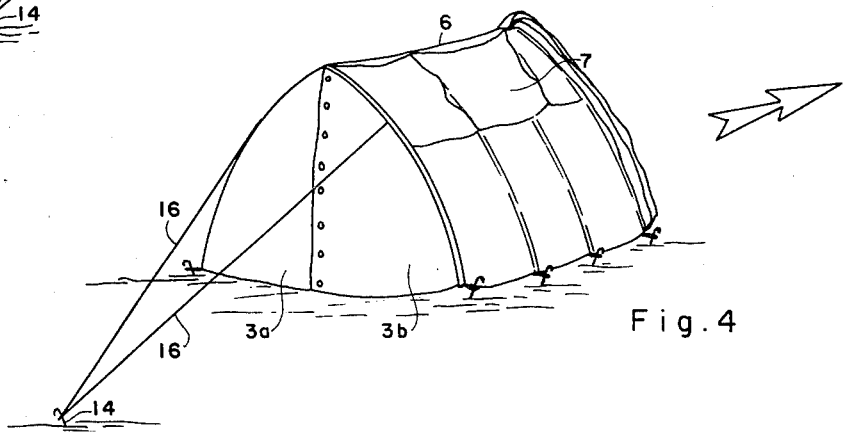

The mode of erection of the shelter from its compact state as shown in FIGS. 2 and 3 of the drawings will now be described.

The collapsed compacted shelter, as seen in FIG. 2 of the drawings, has the support members 2 nested one within the other, and the component portions of the support members pivoted toward each other, and the compacted structure can be fitted in a surrounding sack (not shown) for carrying by a soldier for example.

When the soldier wishes to obtain shelter for example under combat conditions he removes the collapsed compacted shelter from the sack, and as seen in FIG. 3 of the drawings he tethers the tie chords 16 attached to the rear end of the structure by means of a staking pin 14 to the ground and extends the sheltered structure rearwardly, securing the extended structure in position by inserting the staking pins 14 in the appropriate tie loops 12. The extension and erection of the structure thus follows the stages shown graphically in FIGS. 3, 4, 5 and 6 of the drawings, the last stage in the erection of the structure is the tethering of the tie chords 16 attached to the front end of the structure by means of a staking pin 14 and the extension of the radial retaining wall 4 and its maintenance in position by the securing of the tie chords 17.

With the shelter now erected, preferably in a preliminarily formed shallow trench as seen in FIG. 1 of the drawings, the erected shelter is covered with a layer of earth, sand or the like. The initially deposited earth is located in the retaining pockets 7 and against the retaining wall 4 and the downwardly directed force, exerted by the weight of the earth in these retaining pockets 7, is instrumental in ensuring the outward extension of the component support rods 8 of the support members 2. In the absence of such retaining pockets 7 any attempt to cover the erected shelter with earth, sand or the like would result in the initial accumulation of earth around the side walls of the shelter. This accumulation would tend to press these side walls inwardly and the pressure thus generated could possibly result in the collapse of the structure. With the stability of the structure against deformation by the deposited earth thus assured by the downwardly directed pressure of the deposits in the pockets 7, the depositing of the earth or sand is continued until the structure is covered by a sufficient thickness of earth or sand so as to provide adequate protection to an occupant against the effects of bomb or shell blast, shrapnel, etc. and so as effectively to conceal the shelter from easy observation. FIG. 8 shows the shelter when so covered with a protective layer of earth, sand or the like. It will be readily seen that the provisions of the radial retaining wall is effective in retaining the layer in position around the shelter walls, and in preventing the slipping down of some of this layer which could lead to the obstruction of the entrance.

The arched support member can as described above, be formed of pivotally articulated component rods thereby facilitating the compact collapsing of the structure and allowing for the possibility of the nesting of successive support members one inside the other in the collapsed structure. Alternatively, the support members could be formed as integral units.

Furthermore, whilst the shelter specifically described is designed for a single occupant its modification so as to accomodate more than one occupant can be readily envisaged.

In one particular example of a collapsible portable shelter in accordance with the present invention the cover was formed of a PVC fabric reinforced with a synthetic polyamide netting the support members were constituted of aluminum tubes. Such a structure capable of accomodating a single occupant was 2 m. in length, 70 cms wide and had a total weight of 4 kg. The erected structure was capable of supporting a covering sand layer 80 cms in thickness.

I claim:

1. A portable shelter comprising:

(a) flexible fabric-like cover;

(b) a plurality of arch like rigid support members secured to axially spaced apart portions of the cover;

(c) an axially directed elongated retaining pocket formed on or secured to an outer surface of cover adjacent to apical portions of the support members so as to open outwardly and upwardly when the shelter is erected;

said support members and their associated cover being extendable from a position wherein the support members are juxtaposed with respect to each other to a position where the support members are axially spaced apart, supporting therebetween the extended cover member so as to form an elongated enclosure.

2. A shelter according to claim 1 wherein there is furthermore provided a flexible fabric-like base integrally connected to said cover.

3. A shelter according to claim 1 wherein said support members are formed of component curved rods pivotally articulated to each other at apical positions thereof.

4. A shelter according to claim 1 wherein said rods are secured to the cover by being interposed between the cover and strips secured thereto.

5. A shelter according to claim 1 wherein there are furthermore provided fastening loops secured to said support members and staking pins for tethering said loops to the ground.

6. A shelter according to claim 1 and being furthermore provided with end flaps.

7. A shelter according to claim 1 wherein an entrance end of said cover is provided with an integrally formed flange articulated with respect to an outermost support member and means for maintaining said flange in erect position vis a vis the entrance and in the erected condition of said shelter.

8. A shelter according to claim 7 wherein said means comprise radial support rods secured to said flange and the rods secured to said support rods.

* * * * *